US012410630B2

(12) United States Patent
Bassiouni

(10) Patent No.: US 12,410,630 B2
(45) Date of Patent: Sep. 9, 2025

(54) STORM WATER REDIRECTION DEVICE

(71) Applicant: Alaa Bassiouni, Staten Island, NY (US)

(72) Inventor: Alaa Bassiouni, Staten Island, NY (US)

( * ) Notice: Subject to any disclaimer, the term of this patent is extended or adjusted under 35 U.S.C. 154(b) by 118 days.

(21) Appl. No.: 18/438,019

(22) Filed: Feb. 9, 2024

(65) Prior Publication Data

US 2025/0257584 A1 Aug. 14, 2025

(51) Int. Cl.

| | |
|---|---|
| ***E04H 9/14*** | (2006.01) |
| ***E02B 3/10*** | (2006.01) |
| ***E02B 7/28*** | (2006.01) |
| ***E03F 1/00*** | (2006.01) |
| ***E03F 5/04*** | (2006.01) |

(52) U.S. Cl.

CPC ..... *E04H 9/145* (2013.01); *E02B 3/102* (2013.01); *E02B 7/28* (2013.01); *E03F 1/002* (2013.01); *E03F 5/04* (2013.01)

(58) Field of Classification Search

CPC . E02B 3/102; E02B 3/104; E02B 7/28; E04H 9/145; E06B 2009/007

USPC ..... 405/104, 114; 52/169.5, 169.14

See application file for complete search history.

(56) References Cited

U.S. PATENT DOCUMENTS

| | | | | |
|---|---|---|---|---|
| 3,142,460 | A | 7/1964 | Langford | |
| 5,168,584 | A | 12/1992 | Peebles | |
| 5,460,462 | A | 10/1995 | Regan | |
| 6,338,594 | B1 * | 1/2002 | Adler | E02D 5/182 |
| 6,425,707 | B1 | 7/2002 | Baxter | |
| 8,500,365 | B1 | 8/2013 | Vecherin | |
| D696,791 | S | 12/2013 | Taylor | |
| 9,085,864 | B2 * | 7/2015 | Ortiz | E02B 7/005 |
| 9,453,315 | B2 * | 9/2016 | Roy | E06B 9/04 |
| 10,975,538 | B2 | 4/2021 | Adler | |
| 2011/0268506 | A1 * | 11/2011 | Thornbury | E02B 7/205 405/118 |

FOREIGN PATENT DOCUMENTS

| | | | | |
|---|---|---|---|---|
| CA | 2149060 | | 11/1995 | |
| CN | 119162963 | A * | 12/2024 | E06B 9/00 |
| GB | 2438856 | A * | 12/2007 | E02B 7/205 |
| GB | 2464959 | A * | 5/2010 | E02B 7/205 |
| KR | 102695424 | B1 * | 8/2024 | G05D 9/12 |
| KR | 20250085156 | A * | 6/2025 | E06B 9/02 |
| WO | WO-2013160852 | A2 * | 10/2013 | E02B 3/104 |

* cited by examiner

*Primary Examiner* — Frederick L Lagman

(57) ABSTRACT

A storm water redirection device includes a channel drain installed in the ground to completely surround a building to capture storm water. A plurality of barriers is each slidably integrated into the channel drain. Each of the plurality of barriers is positionable in a deployed position to deflect the storm water into the channel drain for collecting the storm water. A first drain pipe is positioned in a respective intersecting section of the channel drain to drain the storm water from the respective channel drain. A second drain pipe is positioned above the first drain pipe to drain the storm water from the channel drain when the storm water is filling the channel drain faster than the first drain pipe can drain the storm water from the channel drain. An overflow reservoir is buried beneath the ground to contain the storm water that drains through the second drain pipe.

14 Claims, 11 Drawing Sheets

STORM WATER REDIRECTION DEVICE

CROSS-REFERENCE TO RELATED APPLICATIONS

Not Applicable

STATEMENT REGARDING FEDERALLY SPONSORED RESEARCH OR DEVELOPMENT

Not Applicable

The Names of the Parties to a Joint Research Agreement

Not Applicable

Incorporation-by-Reference of Material Submitted on a Compact Disc or as a Text File Via the Office Electronic Filing System Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to storm water devices and more particularly pertains to a new storm water device for capturing and redirecting storm water away from a building. The device includes a channel drain that is buried in the ground to surround a building for capturing storm water that runs toward the building. The device includes a plurality of barriers that are each slidably installed in the channel drain which is each positionable in a deployed position to direct the storm water into the channel drain. The device includes a pair of pipes that are integrated into the channel drain. One of the pipes drains the storm water into a municipal storm drain and the other of the pipes drains the storm water into an overflow reservoir that is buried beneath the ground. A sump pump is positioned on the overflow reservoir for pumping storm water from the overflow reservoir into the municipal storm drain.

(2) Description of Related Art Including Information Disclosed Under 37 CFR 1.97 and 1.98

The prior art relates to storm water devices including a variety of storm water drainage channels that are integrated into the ground adjacent to a building for capturing and subsequently redirecting storm water runoff and a variety of erectable flood barriers that can be automatically urged between a deployed position and a stored position. In no instance does the prior art disclose a storm water draining device that includes a channel drain which surrounds a building for capturing storm water runoff and a plurality of barriers slidably integrated into the channel drain for routing the storm water into the channel drain and an overflow reservoir that is in fluid communication with the channel drain for receiving the storm water runoff.

BRIEF SUMMARY OF THE INVENTION

An embodiment of the disclosure meets the needs presented above by generally comprising a channel drain installed in the ground to completely surround a building to capture storm water. A plurality of barriers is each slidably integrated into the channel drain. Each of the plurality of barriers is positionable in a deployed position to deflect the storm water into the channel drain for collecting the storm water. A first drain pipe is positioned in a respective intersecting section of the channel drain to drain the storm water from the respective channel drain. A second drain pipe is positioned above the first drain pipe to drain the storm water from the channel drain when the storm water is filling the channel drain faster than the first drain pipe can drain the storm water from the channel drain. An overflow reservoir is buried beneath the ground to contain the storm water that drains through the second drain pipe.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
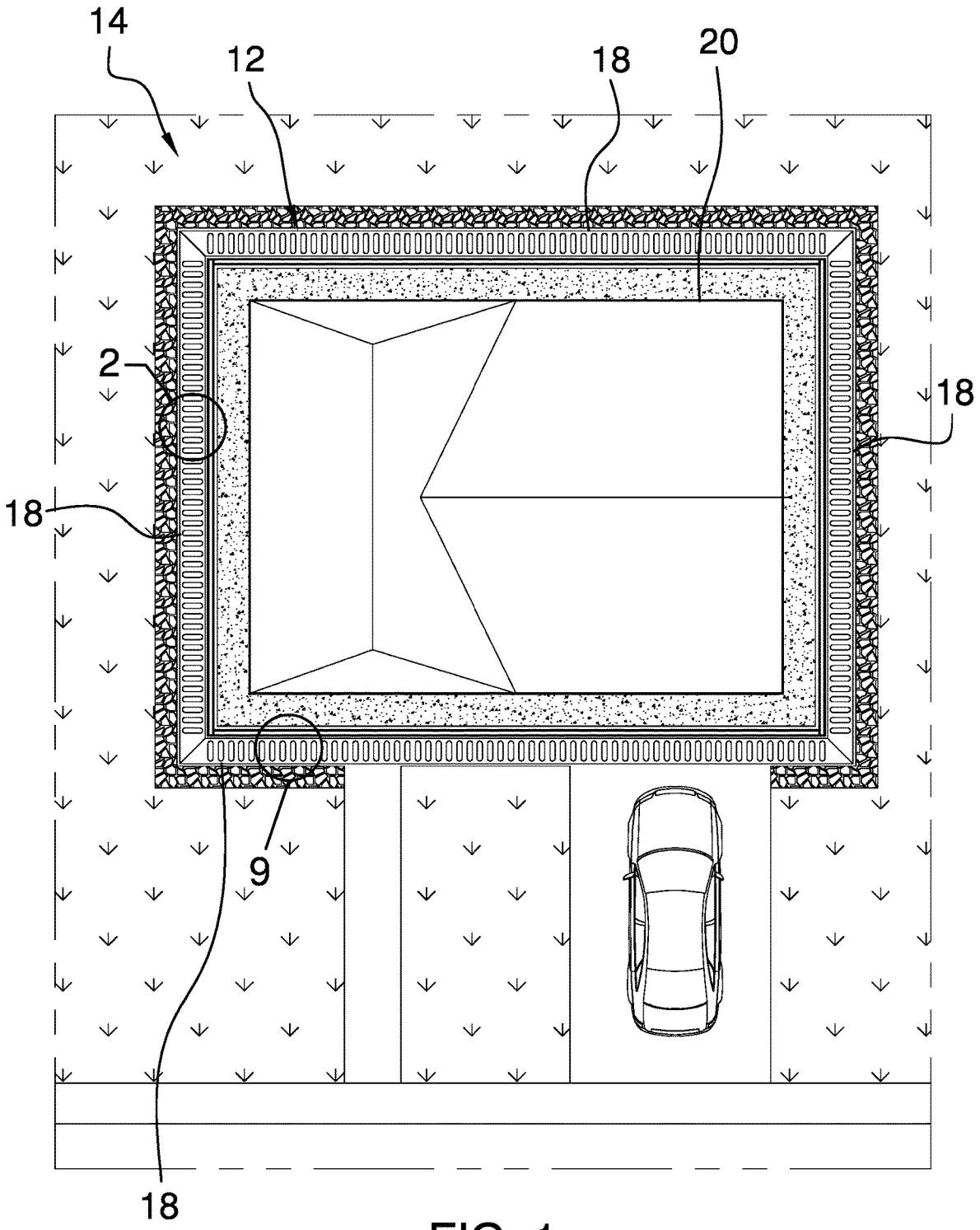
FIG. 1 is a top in-use view of an embodiment of the disclosure.
Figure 2:
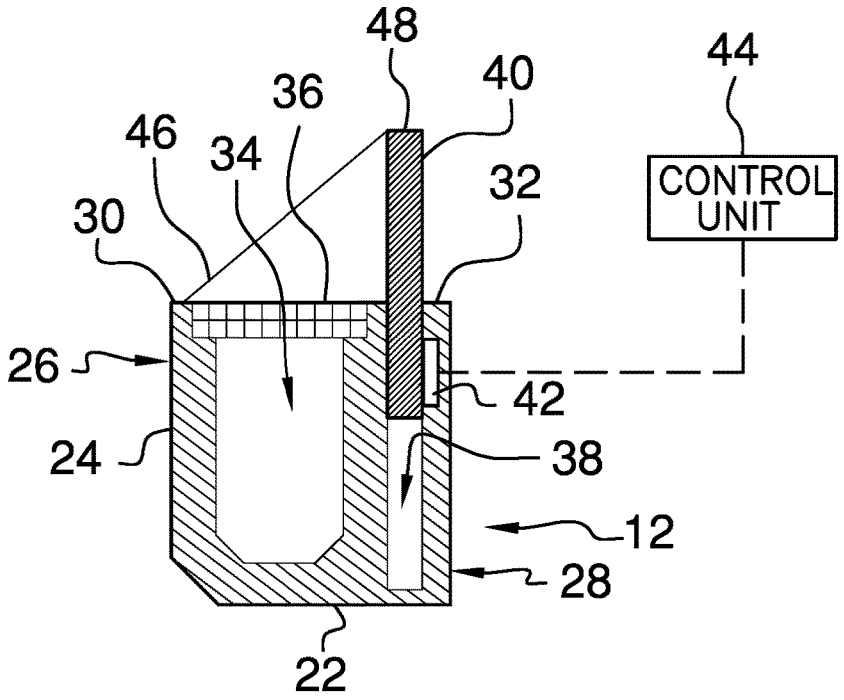
FIG. 2 is a magnified detail view taken from circle 2 of FIG. 1 of an embodiment of the disclosure showing a barrier in a deployed position.
Figure 3:
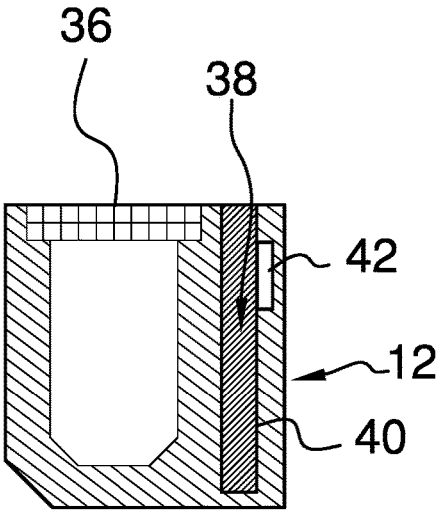
FIG. 3 is a magnified detail view taken from circle 2 of FIG. 1 of an embodiment of the disclosure showing a barrier in a stored position.
Figure 4:
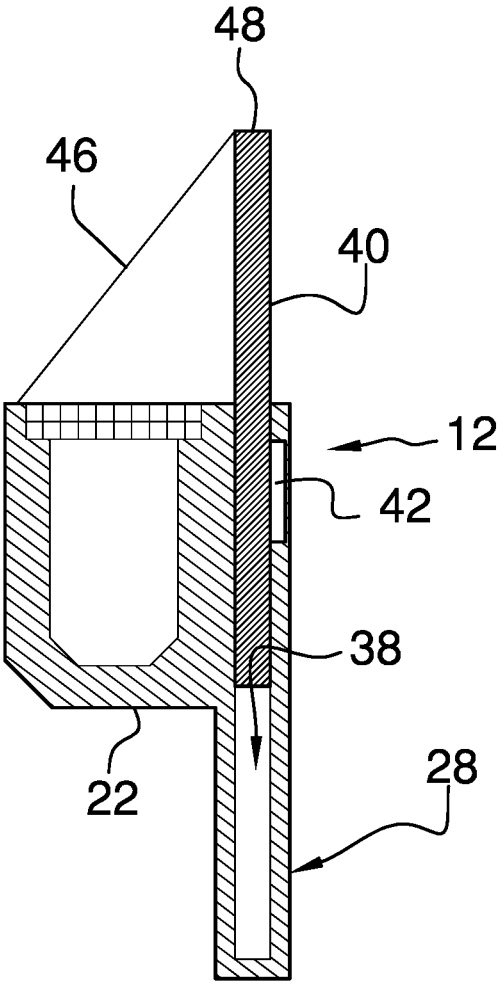
FIG. 4 is a detail view of an alternative embodiment of the disclosure showing a barrier in a deployed position.
Figure 5:
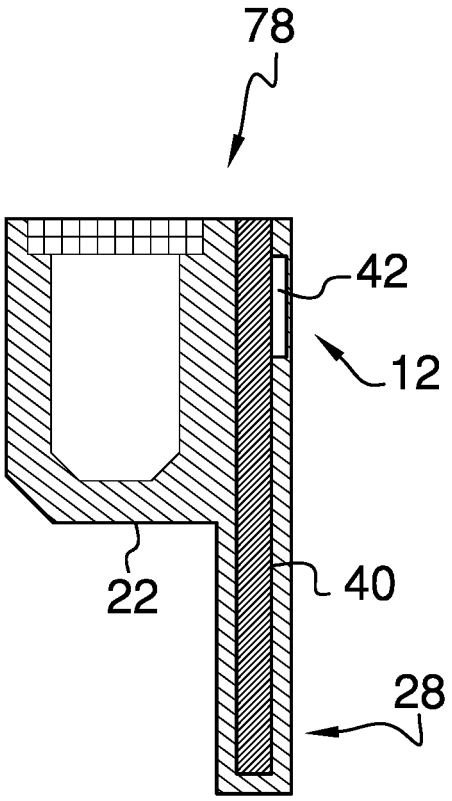
FIG. 5 is a detail view of an alternative embodiment of the disclosure showing a barrier in a stored position.

With reference now to the drawings, and in particular to FIGS. 1 through 22 thereof, a new storm water device embodying the principles and concepts of an embodiment of the disclosure and generally designated by the reference numeral 10 will be described.

As best illustrated in FIGS. 1 through 22, the storm water redirection device 10 generally comprises a channel drain 12 that is installed in the ground 14 to capture storm water 16. The channel drain 12 has a plurality of intersecting sections 18 that form a closed perimeter such that the channel drain 12 completely surrounds a building 20. In this way the channel drain 12 can capture storm water 16 that runs toward the building 20. The building 20 may be a residence, such as a house for example, and the channel drain 12 is comprised of a fluid impermeable material, including but not being limited to, concrete or metal.

The channel drain 12 has a bottom wall 22 and an outer wall 24 extending upwardly from the bottom wall 22 and the outer wall 24 has a front side 26 and a back side 28. The front side 26 has a top edge 30 and the back side 28 has a top edge 32; the top edge 32 of the back side 28 and the top edge 30 of the front side 26 defines an opening 34 into the channel drain 12. Furthermore, the top edge 30 of the front side 26 and the top edge 32 of the back side 28 is aligned with the ground 14. The channel drain 12 includes a foraminous grate 36 that is positionable on top of channel drain 12 to facilitate storm water 16 to flow into the channel drain 12 while inhibiting debris from entering the channel drain 12. The foraminous grate 36 may be recessed into the top edge 32 of the back side 28 of the outer wall 24 and the top edge 30 of the front side 26 of the outer wall 24. The channel drain 12 has a well 38 extending into the top edge 32 of the back side 28 and the well 38 extends along a full length of the back side 28. Additionally, the channel drain 12 is oriented such that the back side 28 is directed toward the building 20.

A plurality of barriers 40 is provided and each of the plurality of barriers 40 is slidably integrated into a respective one of the plurality of intersecting sections 18 of the channel drain 12. Each of the plurality of barriers 40 is positionable in a deployed position having the plurality of barriers 40 extending upwardly from the respective intersecting section 18 of the channel drain 12. In this way the plurality of barriers 40 can deflect the storm water 16 into the respective intersecting section 18 of the channel drain 12 for collecting the storm water 16. Conversely, the plurality of barriers 40 is positionable in a stored position having the plurality of barriers 40 being recessed into the respective intersecting section 18 of the channel drain 12. Each of the barriers 40 is positioned in the well 38 in the respective intersecting section 18 of the channel drain 12 and each of the barriers 40 is comprised of a fluid impermeable material, including but not being limited to, concrete or metal.

A plurality of actuators 42 is included and each of the plurality of actuators 42 is integrated into the back side 28 of the outer wall 24 of a respective one of the plurality of intersecting sections 18 of the channel drain 12. Each of the plurality of actuators 42 is in mechanical communication with the barrier 40 which is positioned in the well 38 in the back side 28 of the outer wall 24 of the respective intersecting section 18 of the channel drain 12. Additionally, each of the plurality of actuators 42 is actuatable into a lifting condition for urging the plurality of barriers 40 in the deployed position. Furthermore, each of the plurality of actuators 42 is actuatable into a lowering condition for urging the plurality of barriers 40 into the stored position.

Each of the plurality of actuators 42 is in electrical communication with a control unit 44 and the control unit 44 actuates each of the plurality of actuators 42 between the lowering condition and the lifting condition. The control unit 44 may comprise a water sensor which senses the flow of rainwater along the ground 14 or the control unit 44 may comprise an electronic control unit with control buttons that can be manipulated by a user. Additionally, each of the plurality of actuators 42 may comprise a linear electromechanical actuator or an electric motor with an associated gear or any other type of mechanical actuator that is capable of both lifting and lowering the respective barrier 40. Alternatively, each of the plurality of barriers 40 can be manually between the stored position and the deployed position in the event that the plurality of actuators 42 is non-functional or to reduce the energy consumption of the actuators 42 thereby reducing the cost of electricity associated with operating the plurality of barriers 40. The manual method of moving the plurality of barriers 40 between the stored position and the deployed position might be accomplished with a chain, for example, or other manual method deemed appropriate by the designer of the plurality of barriers 40.

A plurality of tie lines 46 is included and each of the tie lines 46 is attached between a topmost edge 48 of a respective one of the plurality of barriers 40 and the top edge 30 of the front side 26 of the outer wall 24 of a respective one of the plurality of intersecting sections 18 of the channel drain 12. Each of the tie lines 46 inhibits the respective barrier 40 from being deflected rearwardly when the respective barrier 40 is in the deployed position. In this way the plurality of tie lines 46 reinforce the plurality of barriers 40 against the force of the storm water 16 flowing against the plurality of barriers 40. Each of the plurality of tie lines 46 is comprised of a resilient material, including but not being limited to braided metal cable or a synthetic cable, such that each of the plurality of tie lines 46 has a tensile strength that is sufficient to reinforce the respective barrier 40 against the force of running water. The tie lines 46 transfer the force of the storm water 16 against the barriers 40 into the front side 26 of the outer wall 24 of the respective intersection section 18 of the channel drain 12 thereby increasing the strength of the barriers 40. In the case that the tie lines 46 are not present, the thickness of each of the plurality of barriers 40 is sufficiently increased to facilitate the plurality of barriers 40 to resist the force of the storm water 16 without the additional reinforcement of the tie lines 46. In this way the lateral forces produced by the storm water 16 resulting from a flash flood and the bending moment forces produced by the storm water 16 resulting from a flash flood can be resisted by the plurality of barriers 40.

A first drain pipe 50 is positioned in a respective one of the intersecting sections 18 of the channel drain 12 to drain the storm water 16 from the channel drain 12. The first drain pipe 50 is located adjacent to the bottom wall 22 of the respective intersecting section 18 of the channel drain 12. Additionally, the first drain pipe 50 exits the respective intersecting section 18 of the channel drain 12 and extends beneath ground 14 to terminate in a municipal storm drain 52. In this way the first drain pipe 50 can direct the storm water 16 collected in the channel drain 12 into the municipal storm drain 52. A check valve 53 may be integrated into the first drain pipe 50 at a point located proximate the termination of the first drain pipe 50 to inhibit water from backflowing through the first drain pipe 50 into the channel drain 12. A second drain pipe 54 is positioned in the intersecting section 18 of the channel drain 12 in which the first drain pipe 50 is positioned. Additionally, the second drain pipe 54 is positioned above the first drain pipe 50 thereby facilitating the second drain pipe 54 to drain the storm water 16 from the channel drain 12 when the storm water 16 is filling the channel drain 12 faster than the first drain pipe 50 can drain the storm water 16 from the channel drain 12.

An overflow reservoir 56 is buried beneath the ground 14 such that the overflow reservoir 56 can contain storm water 16. The overflow reservoir 56 is in fluid communication with the second drain pipe 54 to contain the storm water 16 that drains through the second drain pipe 54. Additionally, the overflow reservoir 56 has an access hatch 58 which extends through a top wall 60 of the overflow reservoir 56 to facilitate a user to access the overflow reservoir 56. A ladder 62 is integrated into the overflow reservoir 56 to facilitate the user to climb into and out of the overflow reservoir 56. Additionally, the overflow reservoir 56 has a fill entry 64 which extends through the top wall 60. The second drain pipe 54 extends through the fill entry 64 such that a terminal end 66 of the second drain pipe 54 is positioned inside of the overflow reservoir 56.

A sump pump 68 is provided and the sump pump 68 is positioned within the overflow reservoir 56. The sump pump 68 has an intake 70 and an exhaust 72 and the sump pump 68 urges the storm water 16 that is contained in the overflow reservoir 56 inwardly through the intake 70 and outwardly through the exhaust 72 when the sump pump 68 is turned on. The sump pump 68 may comprise a submersible electric fluid pump or other convention type of sump pump 68 that has an output capacity which is sufficient to completely empty the overflow reservoir 56 in approximately 15.0 minutes or less.

A sump line 74 is fluidly coupled to the exhaust 72 of the sump pump 68 such that the sump line 74 receives the storm water 16 when the sump pump 68 is turned on. The sump line 74 extends out of the overflow reservoir 56 and into the municipal storm drain 52. In this way the sump pump 68 can pump the storm water 16 in the overflow reservoir 56 into the municipal storm drain 52. Thus, the combination of the channel drain 12 and the barriers 40 and the overflow reservoir 56 and the sump pump 68 ensure that the building 20 is not exposed to storm water 16 runoff in even the most severe cases of precipitation or snow melting. Furthermore, a building 20 that is situated in a low lying area, for example, can be protected from what could potentially be an overwhelming amount of storm water 16 runoff during severe storms or snow melt. Additionally, the sump pump 68 might include a water sensor 76 that automatically actuates the sump pump 68 when storm water 16 runoff begins to collect in the overflow reservoir 56 and with automatically deactuates the sump pump 68 when the overflow reservoir 56 has been emptied of the storm water 16 runoff.

In an alternative embodiment 78 as is shown in FIGS. 4, 5, 11 and 12, the back side 28 of the outer wall 24 of the channel drain 12 extends downwardly beyond the bottom wall 22. Each of the plurality of barriers 40 remains partially positioned within the well 38 in the respective intersecting section 18 of the channel drain 12 when the plurality of barriers 40 is in the deployed position. In this way the stability of the plurality of barriers 40 is increased when the plurality of barriers 40 is in the deployed position for withstanding the force of water running against the barriers 40. Furthermore, the back side 28 of the outer wall 24 of each of the channel drain 12 has a thickness that is greater than a thickness of the front side 26 of the outer wall 24 of the channel drain 12.

Figure 6:
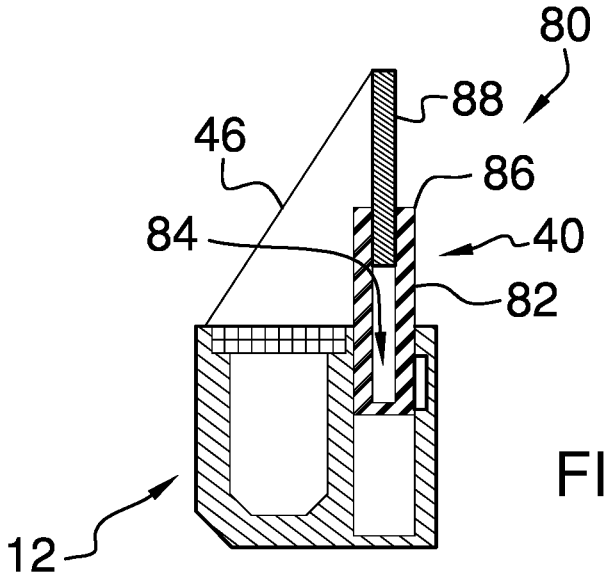
FIG. 6 is a detail view of an alternative embodiment of the disclosure showing a barrier in a second deployed position.
Figure 7:
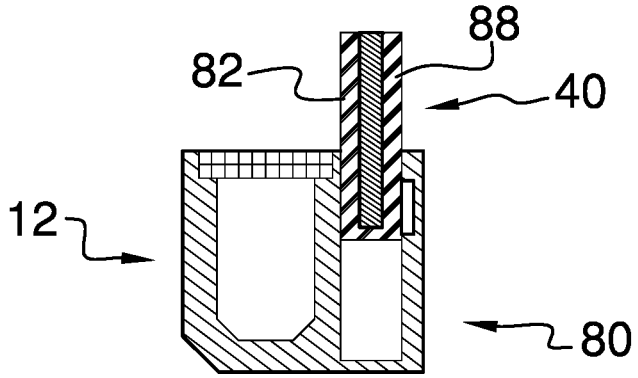
FIG. 7 is a detail view of an alternative embodiment of the disclosure showing a barrier in a first deployed position.
Figure 8:
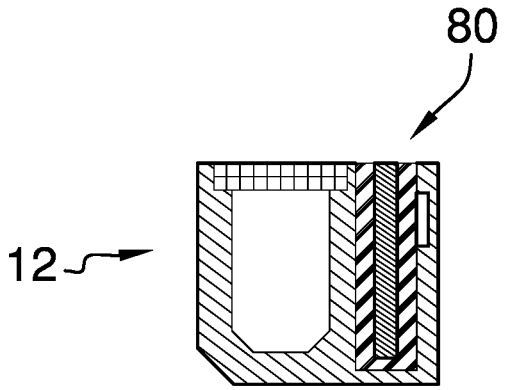
FIG. 8 is a detail view of an alternative embodiment of the disclosure showing a barrier in a stored position.
Figure 9:
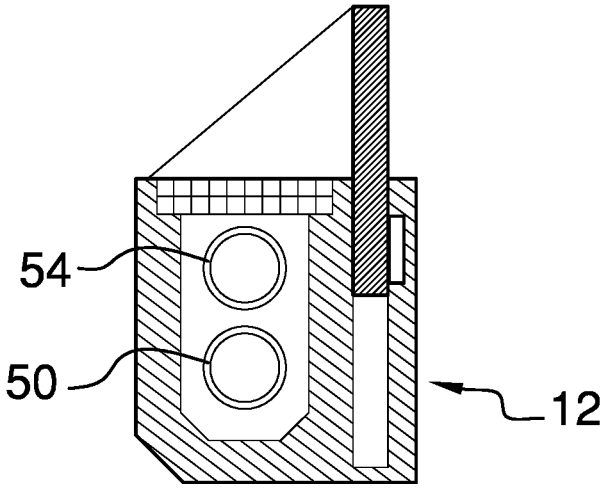
FIG. 9 is a magnified detail view taken from circle 9 of FIG. 1 of an embodiment of the disclosure showing a barrier in a deployed position.
Figure 10:
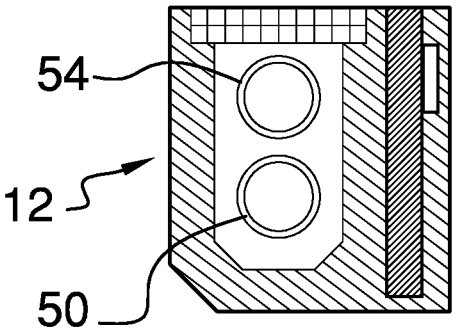
FIG. 10 is a magnified detail view taken from circle 9 of FIG. 1 of an embodiment of the disclosure showing a barrier in a stored position.
Figure 11:
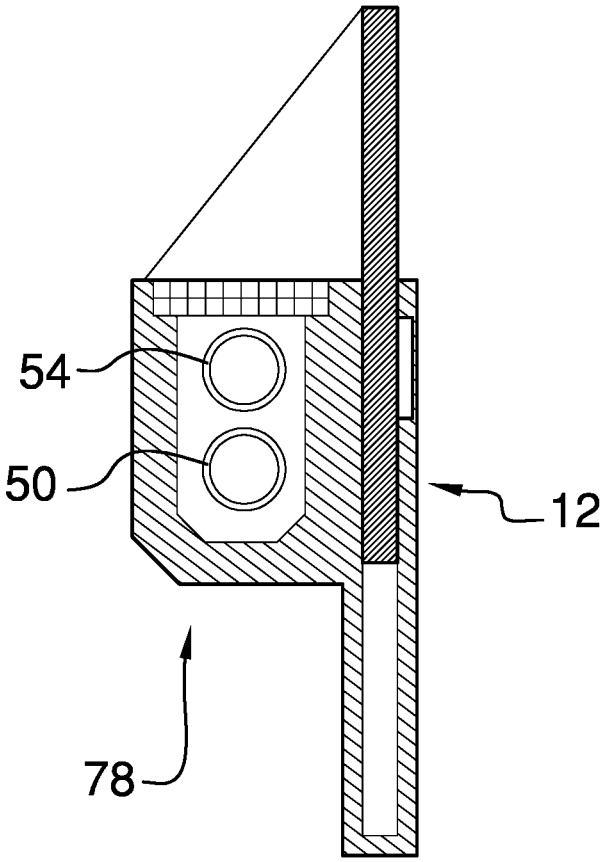
FIG. 11 is a detail view of an alternative embodiment of the disclosure showing a barrier in a deployed position.
Figure 12:
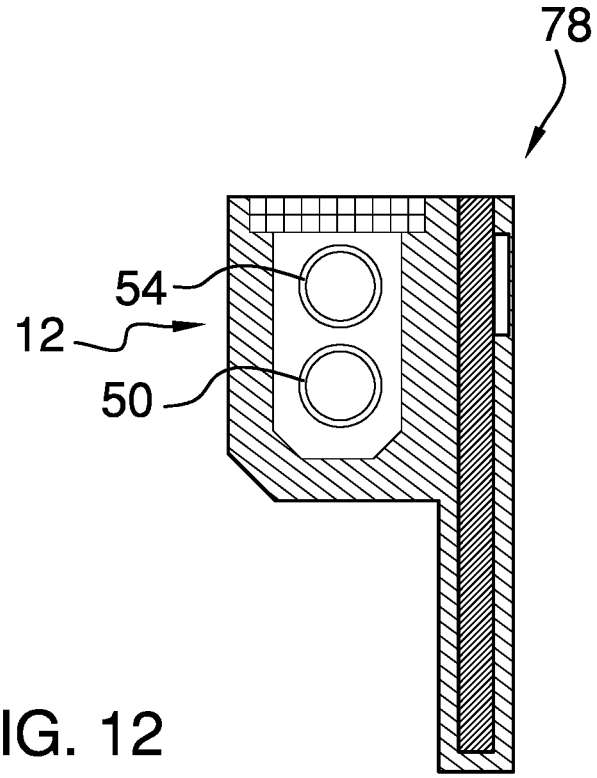
FIG. 12 is a detail view of an alternative embodiment of the disclosure showing a barrier in a stored position.
Figure 13:
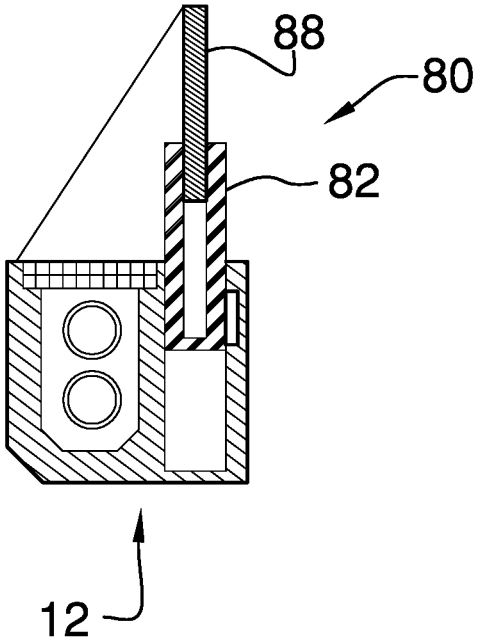
FIG. 13 is a detail view of an alternative embodiment of the disclosure showing a barrier in a second deployed position.
Figure 14:
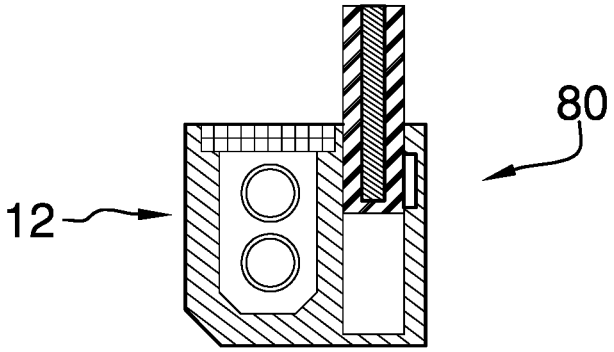
FIG. 14 is a detail view of alternative embodiment of the disclosure showing a barrier in a first deployed position.
Figure 15:
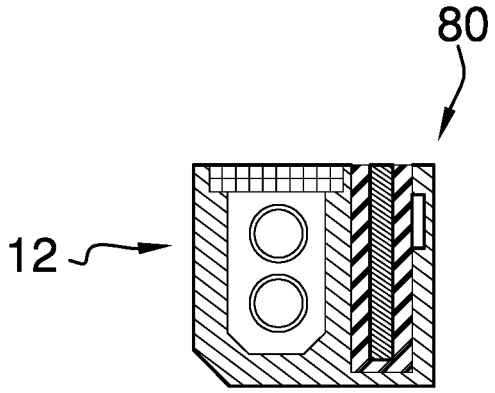
FIG. 15 is a detail view of an alternative embodiment of the disclosure showing a barrier in a stored position.
Figure 16:
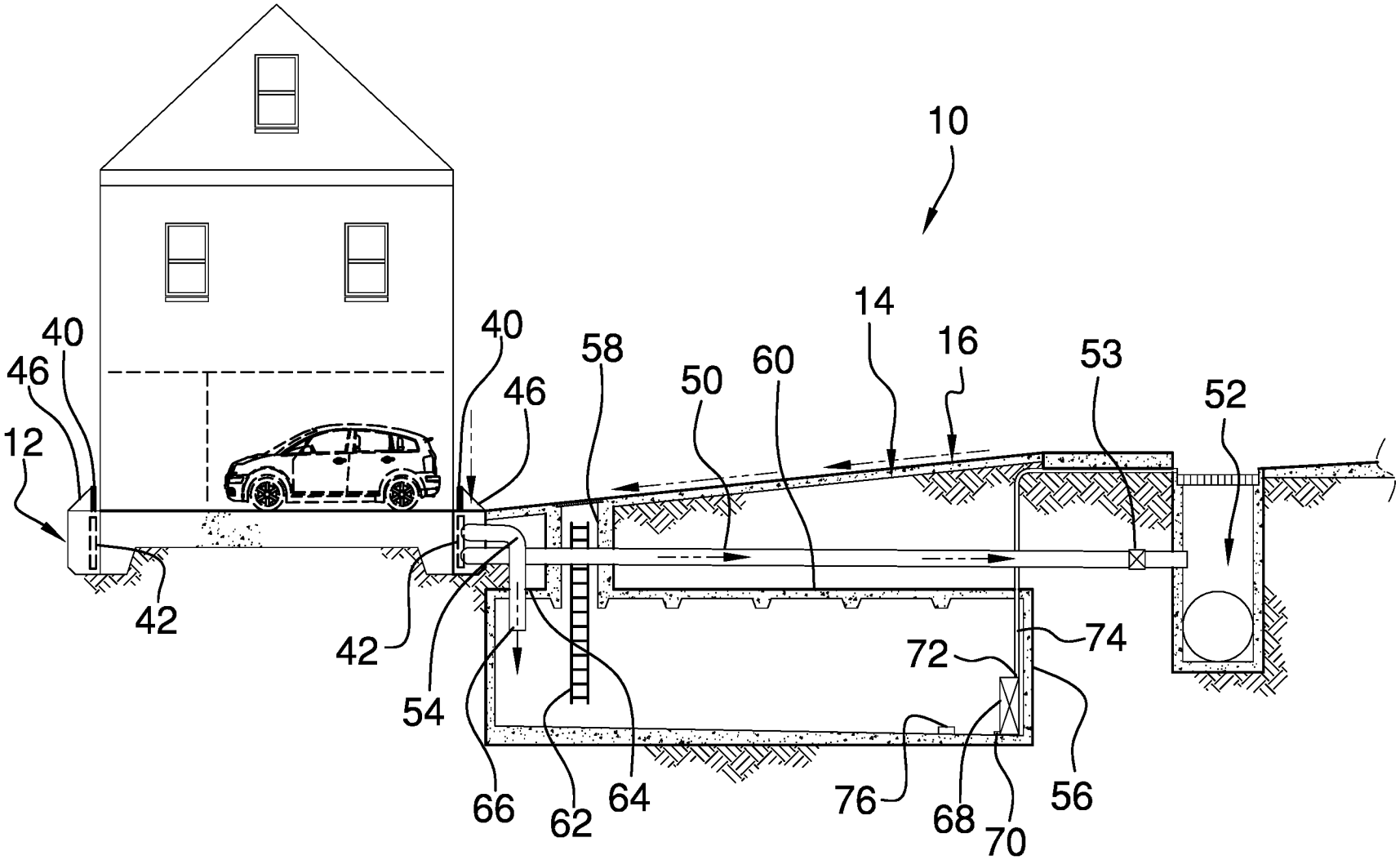
FIG. 16 is cut-away in-use view of a storm water redirection device according to an embodiment of the disclosure.

In an alternative embodiment 80 as shown in FIGS. 6, 7, 8, 13, 14 and 15, each of the plurality of barriers 40 includes a first portion 82 that has a well 84 extending downwardly into an upper edge 86 of the first portion 82. Each of the plurality of barriers 40 includes a second portion 88 that is slidably positioned in the well 84 in the first portion 82. As is shown in FIGS. 7 and 14 each of the plurality of barriers 40 is positionable in a first deployed position having the first portion 82 of each of the plurality of barriers 40 extending partially upwardly from the well 32 in the back side 28 of the outer wall 24 of the respective intersecting section 18 of the channel drain 12. Additionally, the second portion 88 of each of the plurality of barriers 40 is contained within the well 84 in the first portion 82 when the barriers 40 are in the first deployed position. As is shown in FIGS. 6 and 13 each of the plurality of barriers 40 is positionable in a second deployed position having the first portion 82 of each of the plurality of barriers 40 extending partially upwardly from the well 32 in the back side 28 of the outer wall 24 of the respective intersecting section 18 of the channel drain 12 and having the second portion 88 of each of the plurality of barriers 40 extending upwardly from the well 84 in the first portion 82.

Figure 17:
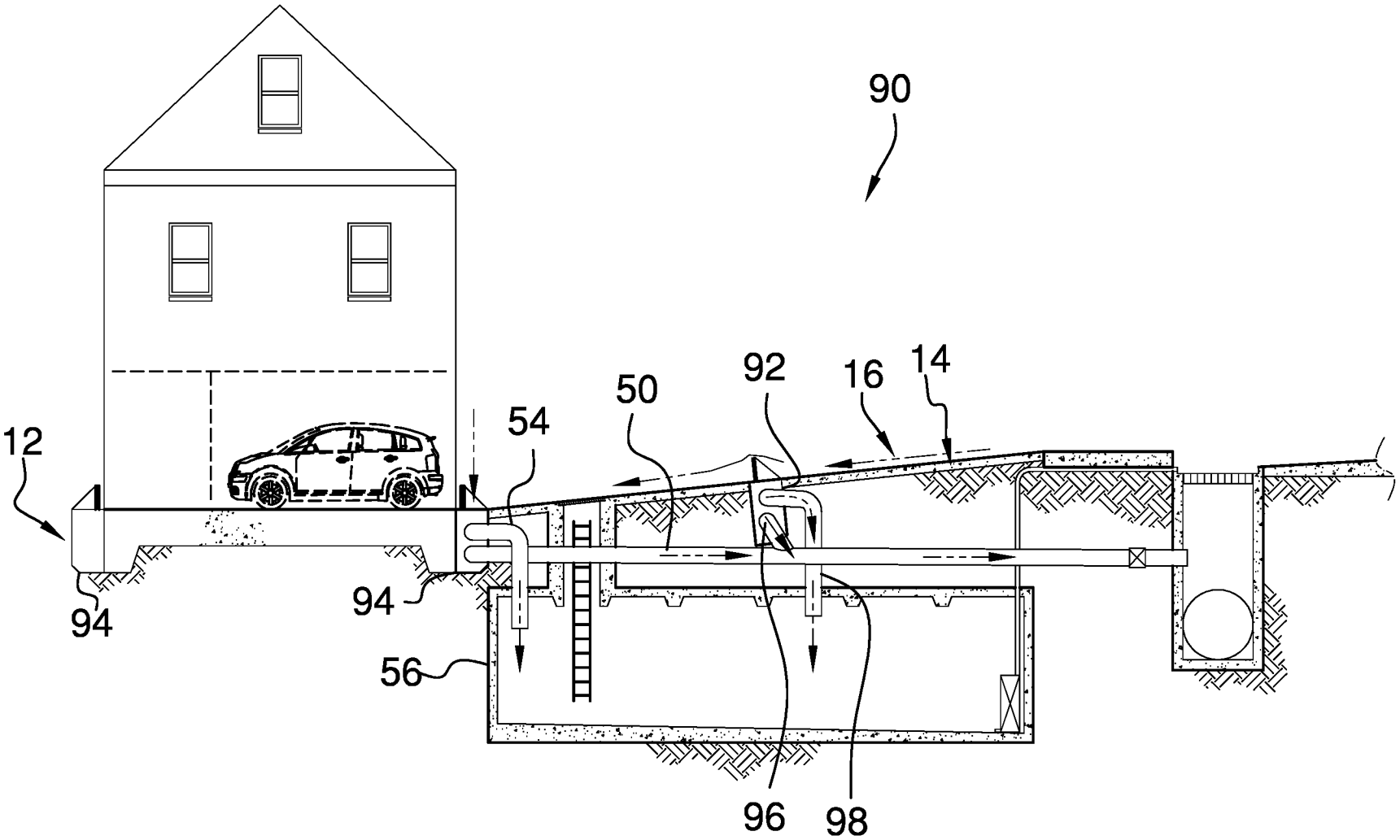
FIG. 17 is a cut-away in-use view of an alternative embodiment of the disclosure.

In an alternative embodiment 90 as is shown in FIG. 17, the plurality of intersecting sections 18 of the channel drain 12 includes a plurality of outer intersecting sections 92 and a plurality of inner intersecting sections 94. Each of the plurality of inner intersecting sections 94 is installed in the ground 14 such that the plurality of inner intersecting sections 94 surrounds the building 20. Furthermore, the plurality of outer intersecting sections 92 is installed in the ground 14 such that the plurality of outer intersecting sections 92 surrounds the plurality of inner intersecting sections 94. Continuing in the alternative embodiment 90, a third drain pipe 96 is positioned in a respective one of the outer intersecting sections 92 of the channel drain 12 to drain the storm water 16 from the outer intersecting sections 92 of the channel drain 12. The third drain pipe 96 is located adjacent to the bottom wall 22 of the respective outer intersecting section 54 of the channel drain 12.

The third drain pipe 96 exits the respective outer intersecting section 54 of the channel drain 12 and extends beneath ground 14 to terminate in the municipal storm drain 52. In this way the third drain pipe 96 can direct the storm water 16 collected in the outer intersecting sections 92 of the channel drain 12 into the municipal storm drain 52. A fourth drain pipe 98 is positioned in the outer intersecting section 54 of the channel drain 12 in which the third drain pipe 96 is positioned and the fourth drain pipe 98 extends into the overflow reservoir 56. The fourth drain pipe 98 is positioned above the third drain pipe 96 to drain the storm water 16 from the outer intersecting sections 92 of the channel drain 12 when the storm water 16 is filling the outer intersecting sections 92 of the channel drain 12 faster than the third drain pipe 96 can drain the storm water 16 from the outer intersecting sections 92 of the channel drain 12. In the event that the third drain pipe 96 and the fourth drain pipe 98 are not sufficient to accommodate the volume of storm water 16 due to the topographic nature of building 20, an additional third drain pipe 96 and an additional fourth drain pipe 98 may be included to ensure that the volume of storm water 16 can be adequately drained. The number of third drain pipes 96 and fourth drain pipes 98 can be increased to whatever number is necessary to handle the volume of the storm water 16 on a case by case basis.

Figure 18:
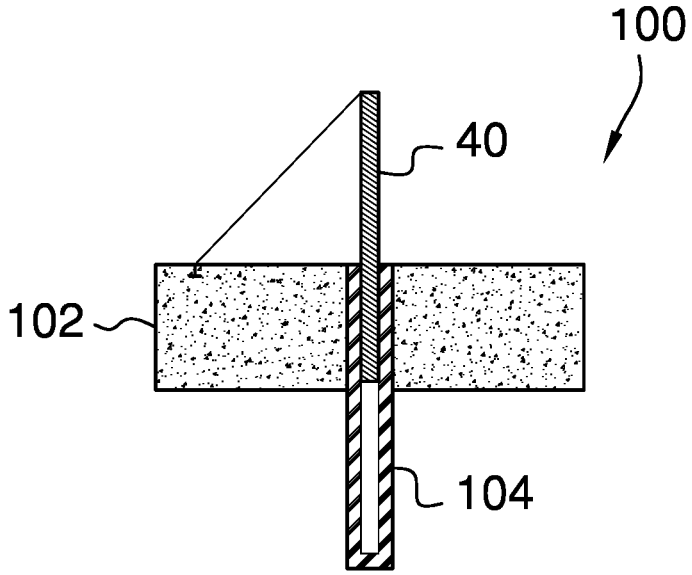
FIG. 18 is a perspective view of barrier only without a channel drain showing a barrier in a deployed position.
Figure 19:
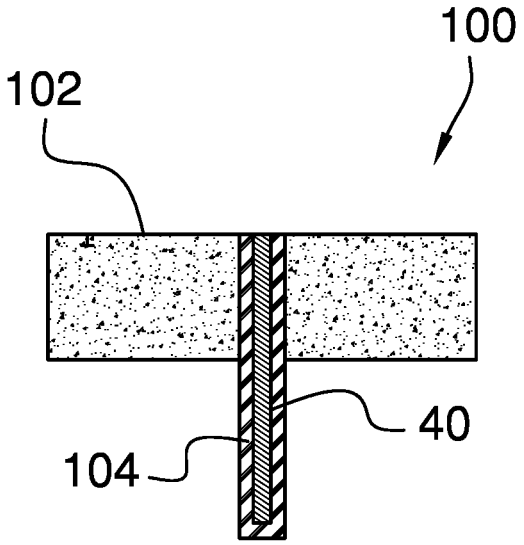
FIG. 19 is a perspective view of a barrier only without a channel drain showing a barrier in a stored position.
Figure 20:
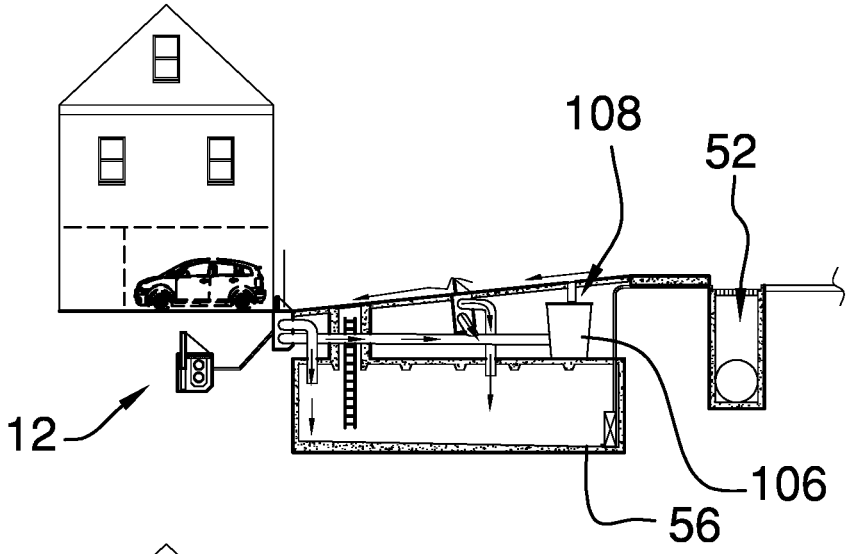
FIG. 20 is a cut-away view of an embodiment of the disclosure showing a sump basin and sump pump added to an overflow reservoir.
Figure 21:
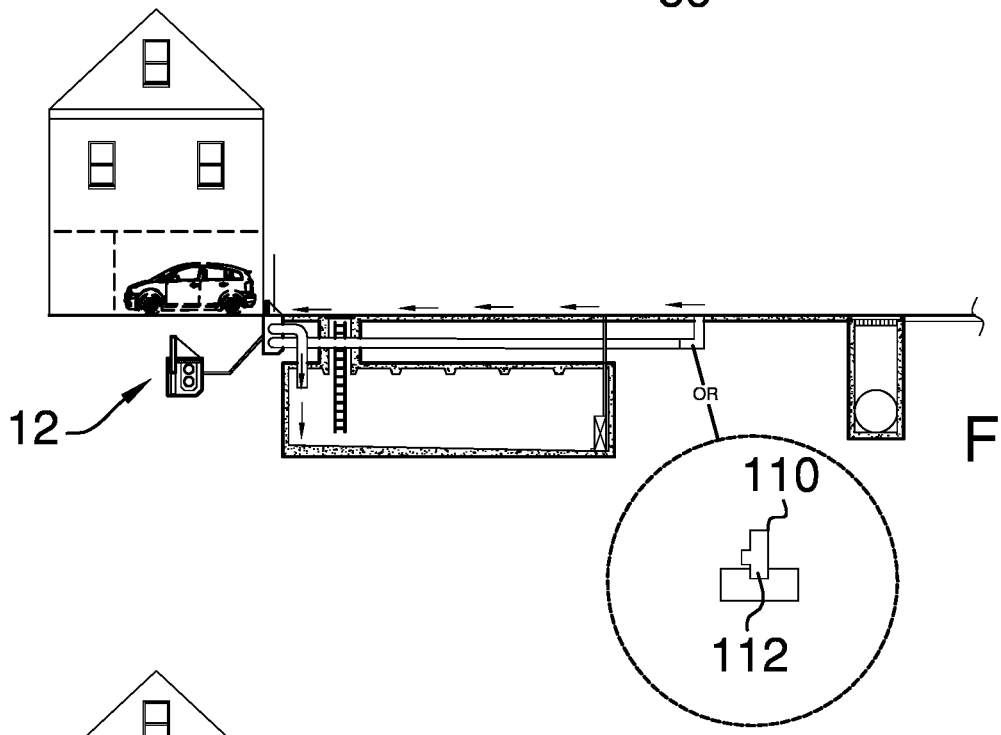
FIG. 21 is a cut-away view of an embodiment of the disclosure showing a cleanout tee.
Figure 22:
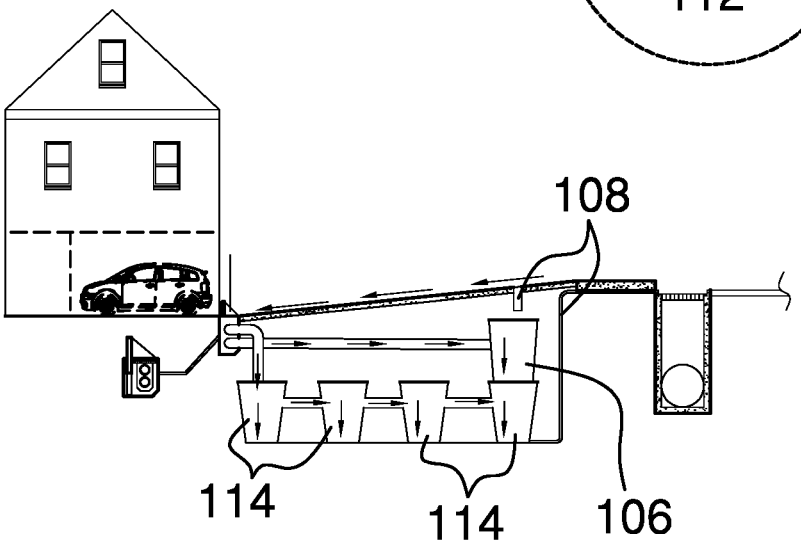
FIG. 22 is a cut-away view of an embodiment of the disclosure demonstrating a series of sump basins and a pair of sump pumps.

As is shown in FIGS. 18 and 19, the channel drain 12 may include a barrier only channel drain 100 which includes a slab 102 and a sleeve 104 which extends downwardly through the slab 102; the barrier 40 and the associated actuator 42 are positioned in the sleeve 104. The barrier 40 extends upwardly from the sleeve 104 when the barrier 40 is in the deployed position and the barrier 40 is contained within the sleeve 104 when the barrier 40 is in the stored position. In this way barrier only channel drain 100 can be strategically located to redirect the storm water 16 runoff away from the building 20 rather than to collect the storm water 16 runoff when the barrier 40 in the barrier only channel drain 100 is in the deployed position. FIGS. 20 through 22 demonstrate various means of structuring the overflow reservoir 56 and the means of routing the storm water 16 into the municipal storm drain 52 to accommodate the topographic nature of the location of the building 20 to ensure the storm water 16 is adequately drained. FIG. 20 demonstrates that a sump basin 106 and a sump pump 108 can be added to the overflow reservoir 56. FIG. 21 demonstrates a cleanout tee 110 which is surrounded by drainage rock 112 and FIG. 22 demonstrates a series of sump basins 114, either perforated or solid, which serve as a replacement for the overflow reservoir 56 and additionally shows a sump basin 106 and pair of sump pumps 108.

In use, the control unit 44 actuates the plurality of barriers 40 into the deployed position when the building 20 is exposed to storm water 16 runoff. In this way the barriers 40 direct the storm water 16 runoff into the channel drain 12 to inhibit the storm water 16 from reaching the building 20 and potentially causing flood damage. Furthermore, the storm water 16 runoff is subsequently drained into the overflow reservoir 56 when the storm water 16 runoff collects in the channel drain 12. In this way the building 20 can be protected from even the most severe cases of storm water 16 runoff. The sump pump 68 in the overflow reservoir 56 is actuated when the overflow reservoir 56 begins to collect the storm water 16 runoff thereby inhibiting the overflow reservoir 56 from becoming overfilled with the storm water 16 runoff.

With respect to the above description then, it is to be realized that the optimum dimensional relationships for the parts of an embodiment enabled by the disclosure, to include variations in size, materials, shape, form, function and manner of operation, device and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A storm water redirection device for redirecting storm water away from a building and into a municipal storm drain, said device comprising:

a channel drain being installed in the ground wherein said channel drain is configured to capture storm water, said channel drain having a plurality of intersecting sections that form a closed perimeter such that said channel drain completely surrounds a building wherein said channel drain is configured to capture storm water that runs toward said building;

a plurality of barriers, each of said plurality of barriers being slidably integrated into a respective one of said plurality of intersecting sections of said channel drain, each of said plurality of barriers being positionable in a deployed position having said plurality of barriers extending upwardly from said respective intersecting section of said channel drain wherein said plurality of barriers is configured to deflect the storm water into said respective intersecting section of said channel drain for collecting the storm water, said plurality of barriers being positionable in a stored position having said plurality of barriers being recessed into said respective intersecting section of said channel drain;

a first drain pipe being positioned in a respective one of said intersecting sections of said channel drain wherein first drain pipe is configured to drain the storm water from said respective channel drain;

a second drain pipe being positioned in said intersecting channel drain in which said first drain pipe is positioned, said second drain pipe being positioned above said first drain pipe wherein said second drain pipe is configured to drain the storm water from said channel drain when the storm water is filling said channel drain faster than said first drain pipe can drain the storm water from said channel drain; and an overflow reservoir being buried beneath the ground wherein said overflow reservoir is configured to contain storm water, said overflow reservoir being in fluid communication with said second drain pipe wherein said overflow reservoir is configured to contain the storm water that drains through said second drain pipe.

2. The device according to claim 1, wherein:

said channel drain has a bottom wall and an outer wall, extending upwardly from said bottom wall;

said outer wall has a front side and a back side, said front side having a top edge, said back side having a top edge;

said top edge of said back side and said top edge of said front side defines an opening into said channel drain;

said top edge of said back side and said top edge of said back side being aligned with the ground;

said channel drain includes a foraminous grate being positionable on top of said channel drain wherein said foraminous grate is configured to facilitate storm water to flow into said channel drain while inhibiting debris from entering said channel drain;

said channel drain has a well extending into said top edge of said back side;

said well extends along a full length of said back side; and said channel drain is oriented such that said back side is directed toward said building.

3. The device according to claim 2, wherein:

each of said barriers is positioned in said well in said respective intersecting section of said channel drain;

said device includes a plurality of actuators;

each of said plurality of actuators is integrated into said back side of said outer wall of a respective one of said plurality of intersecting sections of said channel drain; and each of said plurality of actuators is in mechanical communication with said barrier which is positioned in said well in said back side of said outer wall of said respective intersecting section of said channel drain.

4. The device according to claim 3, wherein:

each of said plurality of actuators is actuatable into a lifting condition for urging said plurality of barriers into said deployed position;

each of said plurality of actuators is actuatable into a lowering condition for urging said plurality of barriers into said stored position;

each of said plurality of actuators is in electrical communication with a control unit; and said control unit actuates each of said plurality of actuators between said lowering condition and said lifting condition.

5. The device according to claim 2, further comprising a plurality of tie lines, each of said tie lines being attached between a topmost edge of a respective one of said plurality of barriers and said top edge of said front side of said outer wall of a respective one of said plurality of intersecting sections of said channel drain, each of said tie lines inhibiting said respective barrier from being deflected rearwardly when said respective barrier is in said deployed position wherein said plurality of tie lines is configured to reinforce said plurality of barriers against the force of the storm water flowing against said plurality of barriers.

6. The device according to claim 2, wherein said first drain pipe is located adjacent to said bottom wall of said respective intersecting section of said channel drain, said first drain pipe exiting said respective intersecting section of said channel drain and extending beneath ground to terminate in a municipal storm drain wherein said first drain pipe is configured to direct the storm water collected in said channel drain into said municipal storm drain.

7. The device according to claim 1, wherein:

said overflow reservoir has an access hatch extending through a top wall of said overflow reservoir wherein said access hatch is configured to facilitate a user to access said overflow reservoir;

said overflow reservoir has a fill entry extending through said top wall; and said second drain pipe extends through said fill entry such that a terminal end of said second drain pipe is positioned inside of said overflow reservoir.

8. The device according to claim 1, further comprising a sump pump being positioned within said overflow reservoir, said sump pump having an intake and an exhaust wherein said sump pump is configured to urge the storm water in said overflow reservoir inwardly through said intake and outwardly through said exhaust when said sump pump is turned on.

9. The device according to claim 8, further comprising a sump line being fluidly coupled to said exhaust of said sump pump wherein said sump line is configured to receive the storm water when said sump pump is turned on, said sump line extending out of said overflow reservoir and into said municipal storm drain wherein said sump pump is configured to pump the storm water in said overflow reservoir into said municipal storm drain.

10. A storm water redirection device for redirecting storm water away from a building and into a municipal storm drain, said device comprising:

a channel drain being installed in the ground wherein said channel drain is configured to capture storm water, said channel drain having a plurality of intersecting sections that form a closed perimeter such that said channel drain completely surrounds a building wherein said channel drain is configured to capture storm water that runs toward said building, said channel drain having a bottom wall and an outer wall extending upwardly from said bottom wall, said outer wall having a front side and a back side, said front side having a top edge, said back side having a top edge, said top edge of said back side and said top edge of said front side defining an opening into said channel drain, said top edge of said front side and said top edge of said back side being aligned with the ground, said channel drain including a foraminous grate being positionable on top of channel drain wherein said foraminous grate is configured to facilitate storm water to flow into said channel drain while inhibiting debris from entering said channel drain, said channel drain having a well extending into said top edge of said back side, said well extending along a full length of said back side, said channel drain being oriented such that said back side is directed toward said building;

a plurality of barriers, each of said plurality of barriers being slidably integrated into a respective one of said plurality of intersecting sections of said channel drain, each of said plurality of barriers being positionable in a deployed position having said plurality of barriers extending upwardly from said respective intersecting section of said channel drain wherein said plurality of barriers is configured to deflect the storm water into said respective intersecting section of said channel drain for collecting the storm water, said plurality of barriers being positionable in a stored position having said plurality of barriers being recessed into said respective intersecting section of said channel drain, each of said barriers being positioned in said well in said respective intersecting section of said channel drain;

a plurality of actuators, each of said plurality of actuators being integrated into said back side of said outer wall of a respective one of said plurality of intersecting sections of said channel drain, each of said plurality of actuators being in mechanical communication with said barrier which is positioned in said well in said back side of said outer wall of said respective intersecting section of said channel drain, each of said plurality of actuators being actuatable into a lifting condition for urging said plurality of barriers in said deployed position, each of said plurality of actuators being actuatable into a lowering condition for urging said plurality of barriers into said stored position, each of said plurality of actuators being in electrical communication with a control unit, said control unit actuating each of said plurality of actuators between said lowering condition and said lifting condition;

a plurality of tie lines, each of said tie lines being attached between a topmost edge of a respective one of said plurality of barriers and said top edge of said front side of said outer wall of a respective one of said plurality of intersecting sections of said channel drain, each of said tie lines inhibiting said respective barrier from being deflected rearwardly when said respective barrier is in said deployed position wherein said plurality of tie lines is configured to reinforce said plurality of barriers against the force of the storm water flowing against said plurality of barriers;

a first drain pipe being positioned in a respective one of said intersecting sections of said channel drain wherein first drain pipe is configured to drain the storm water from said channel drain, said first drain pipe being located adjacent to said bottom wall of said respective intersecting section of said channel drain, said first drain pipe exiting said respective intersecting section of said channel drain and extending beneath ground to terminate in a municipal storm drain wherein said first drain pipe is configured to direct the storm water collected in said channel drain into said municipal storm drain;

a second drain pipe being positioned in said intersecting section of said channel drain in which said first drain pipe is positioned, said second drain pipe being positioned above said first drain pipe wherein said second drain pipe is configured to drain the storm water from said channel drain when the storm water is filling said channel drain faster than said first drain pipe can drain the storm water from said channel drain;

an overflow reservoir being buried beneath the ground wherein said overflow reservoir is configured to contain storm water, said overflow reservoir being in fluid communication with said second drain pipe wherein said overflow reservoir is configured to contain the storm water that drains through said second drain pipe, said overflow reservoir having an access hatch extending through a top wall of said overflow reservoir wherein said access hatch is configured to facilitate a user to access said overflow reservoir, said overflow reservoir having a fill entry extending through said top wall, said second drain pipe extending through said fill entry such that a terminal end of said second drain pipe is positioned inside of said overflow reservoir;

a sump pump being positioned within said overflow reservoir, said sump pump having an intake and an exhaust wherein said sump pump is configured to urge the storm water in said overflow reservoir inwardly through said intake and outwardly through said exhaust when said sump pump is turned on; and a sump line being fluidly coupled to said exhaust of said sump pump wherein said sump line is configured to receive the storm water when said sump pump is turned on, said sump line extending out of said overflow reservoir and into said municipal storm drain wherein said sump pump is configured to pump the storm water in said overflow reservoir into said municipal storm drain.

11. The device according to claim 10, wherein:

said back side of said outer wall of said channel drain extends downwardly beyond said bottom wall; and each of said plurality of barriers remains partially positioned within said well in said respective intersecting section of said channel drain when said plurality of barriers is in said deployed position thereby increasing stability of said plurality of barriers when said plurality of barriers is in said deployed position.

12. The device according to claim 10, wherein:

said back side of said outer wall of each of said channel drain has a thickness that is greater than a thickness of said front side of said outer wall of said channel drain;

each of said plurality of barriers includes a first portion having a well extending downwardly into an upper edge of said first portion;

each of said plurality of barriers includes a second portion being slidably positioned in said well in said first portion;

each of said plurality of barriers being positionable in a first deployed position having said first portion of each of said plurality of barriers extending partially upwardly from said well in said back side of said outer wall of said respective intersecting section of said channel drain and having said second portion of each of said plurality of barriers being contained within said well in said back side of said outer wall of said respective intersecting section of said channel drain; and each of said plurality of barriers being positionable in a second deployed position having said first portion of each of said plurality of barriers extending partially upwardly from said well in said back side of said outer wall of said respective intersecting section of said channel drain.

13. The device according to claim 10, wherein:

said plurality of intersecting sections of said channel drain includes a plurality of outer intersecting sections and a plurality of inner intersecting sections;

each of said plurality of inner intersecting sections is installed in the ground such that said plurality of inner intersecting sections surrounds said building; and said plurality of outer intersecting sections is installed in the ground such that said plurality of outer intersecting sections surrounds said plurality of inner intersecting sections.

14. The device according to claim 13, further comprising:

a third drain pipe being positioned in a respective one of said outer intersecting sections of said channel drain wherein third drain pipe is configured to drain the storm water from said outer intersecting sections of said channel drain, said third drain pipe being located adjacent to said bottom wall of said respective outer intersecting section of said channel drain, said third drain pipe exiting said respective outer intersecting section of said channel drain and extending beneath ground to terminate in said municipal storm drain wherein said third drain pipe is configured to direct the storm water collected in said outer intersecting sections of said channel drain into said municipal storm drain; and a fourth drain pipe being positioned in said outer intersecting section of said channel drain in which said third drain pipe is positioned, said fourth drain pipe being positioned above said third drain pipe wherein said fourth drain pipe is configured to drain the storm water from said outer intersecting sections of said channel drain when the storm water is filling said channel drain faster than said third drain pipe can drain the storm water from said outer intersecting sections of said channel drain.

* * * * *